United States Patent [19]

Robertson et al.

[11] Patent Number: 4,622,201

[45] Date of Patent: Nov. 11, 1986

[54] GAS-TARGET METHOD FOR THE PRODUCTION OF IODINE-123

[75] Inventors: Robert Robertson, Vancouver; Donald C. Stuart, Ottawa, both of Canada

[73] Assignee: Atomic Energy of Canada Ltd., Ottawa, Canada

[21] Appl. No.: 409,376

[22] Filed: Aug. 18, 1982

[30] Foreign Application Priority Data

Jun. 1, 1982 [CA] Canada ..... 404175

[51] Int. Cl.[4] ..... G21G 1/10

[52] U.S. Cl. ..... 376/192; 376/195

[58] Field of Search ..... 376/194, 195, 192

[56] References Cited

U.S. PATENT DOCUMENTS

| | | | |
|---|---|---|---|
| 3,694,313 | 9/1972 | Blue et al. | 376/198 |
| 3,966,547 | 6/1976 | Blue | 376/192 |
| 3,971,697 | 7/1976 | Blue | 376/192 |
| 4,088,532 | 5/1978 | Blue et al. | 376/198 |

FOREIGN PATENT DOCUMENTS 671194 2/1980 U.S.S.R. .

OTHER PUBLICATIONS

Nordell, B. et al., "Production of $^{123}$I by Photonuclear Reactions on Xenon", *Int. Journal of Applied Radiations and Isotopes,* vol. 33, Mar. 1982, pp. 183–187.

Grabmayer et al, "Statistical-Model Based Evaluations of Reactions Producing $^{123}$I and $^{127}$Xe", *IJARI* vol. 29 (1978), pp. 261–267.

*Primary Examiner*—Teddy S. Gron

*Assistant Examiner*—Virginia B. Caress

*Attorney, Agent, or Firm*—Beveridge, DeGrandi and Weilacher

[57] ABSTRACT

Charged-particles in the 45–15 MeV energy range incident upon isotopically enriched xenon-124 gas in a gas-target assembly cause nuclear reactions which yield radioactive xenon-123. The xenon-123, decaying either in the target assembly or in a decay vessel removed from the target assembly, yields iodine-123 with very low levels of radioactive contaminants.

7 Claims, 2 Drawing Figures

GAS-TARGET METHOD FOR THE PRODUCTION OF IODINE-123

LITERATURE SURVEY

There are many publications concerned with the production of iodine 123. Three reviews are given by: Sodd et al, Isotop. Radiat. Technol. 9 (1971/1972) 154–159, "Evaluation of Nuclear Reactions That Produce I-123 in the Cyclotron"; Weinreich, Proceedings of the Panel Discussion, "Iodine-123 in Western Europe. Production, Application, Distribution", Julich, Feb. 13, 1976, "Critical Comparison of Production Methods for Iodine-123", pages 49–69; Van den Bosch, Thesis, Technische Hogeschool Eindhoven, The Netherlands, Oct. 1979. "Production of I-123, Br-77, and Y-87 with the Eindhoven AVF Cyclotron". The applicability of iodine-123 to diagnostic studies and its advantages over other radioiodines are outlined in these reviews and by Myers et al, Radio-pharmaceuticals and Labelled Compounds, Vol. 1, Vienna, IAEA/SM-171/34, 1973, "Radioiodine-123 for Applications in Diagnosis".

Iodine-123 production routes may be divided into two general categories. The first concerns nuclear reaction pathways which form iodine-123 directly, such as the reaction $^{124}$Te (p, 2n) $^{123}$I.

The second category consists of indirect routes which lead to iodine-123 formation via the xenon-123 precursor, such as the reaction $^{127}$I (p, 5n) $^{123}$Xe→$^{123}$I.

A summary of references follows. These have been divided into six sub-groups. The sub-groups are:

| SUB-GROUPS | REFERENCES |
|---|---|
| General | 1–5 |
| Cross-sections/Theory | 6–9 |
| High-Energy, indirect reactions | 10–32 |
| *Low-energy, direct reactions | 33–51 |
| *Low-energy, indirect reactions | 52–56 |
| Other | 57 |

*Low-energy implies here the use of charged particles of energy less than 50 MeV; i.e. within the charged-particle energy capabilities of the modern compact cyclotrons generally used for commercial radioisotope production.

BACKGROUND OF THE INVENTION

Because of its nuclear and chemical properties, the radioisotope iodine-123 (half-life 13.2 hours) is much in demand in nuclear medicine as a radiopharmaceutical for diagnostic imaging. Commercial distribution and use of the isotope within the medical community, however, is greatly hampered because most supplies are of a product with a shelf-life of only 1–2 days after factory preparation. This limited life is brought about by the fact that the viable production reactions applied by most commercial suppliers through their compact industrial cyclotrons and other low-energy accelerators lead to a product contaminated with radioiodine impurities which increase in relative concentration with time and lead to technical problems in product use. A reliable, large-scale supply of higher purity iodine-123, manufacturable via a compact industrial cyclotron, is highly desirable to allow fuller commercial and medical exploitation of the isotope's potential.

Direct Formation of Iodine-123

There are two general categories of nuclear reaction in use for the production of iodine-123. The first, and most widely utilised class, are those reactions which yield iodine-123 directly and which require the separation of the iodine-123 species itself from the irradiated target. These reactions give optimum product yields using charged particles of less than 50 MeV for target bombardment and are generally favoured by industrial producers and others possessing small nuclear accelerators such as the commercially available compact cyclotrons.

The direct mechanisms are typified by the reaction $^{124}$Te (p, 2n) $^{123}$I, where a target of isotopically enriched tellurium-124, as elemental Te or as the dioxide $TeO_2$, and incident protons of about 26 MeV are employed. This example reaction is in fact the most utilised of the direct routes and is generally chosen for large-scale and commercial production as the best compromise considering: product yield, product purity, cost and availability of enriched target, convenience of targetry and chemistry, and convenience of using protons for target bombardment as opposed to other particles such as deuterons and helium ions.

The product made by the $^{124}$Te (p, 2n) $^{123}$I or any other direct reaction route, however, is by no means ideal for medical applications. Because of associated nuclear reactions in the target, it is unavoidably contaminated by other radioiodines, mainly iodine-124 (half-life 4.2 days) and to a lesser extent by iodine-125 (half-life 60 days), and iodine-126 (half-life 13 days). These long-lived contaminants increase in concentration with time relative to the shorter-lived iodine-123, reducing the useful life of the iodine-123 preparation. A typical preparation would have an initial iodine-124 contaminant relative activity level in the range 0.7–1.0%. After a shelf-life of 36 hours, this range would have increased to 3.6–5.2%, at which levels diagnostic image quality is seriously degraded by high-energy gamma-rays, and patient radiation dose to the critical organ (thyroid) is undesirably raised by a factor of about 4 relative to the dose which would have been delivered by corresponding administration of a pure iodine-123 preparation.

Indirect Formation of Iodine-123

The second general class of nuclear reactions used for iodine-123 production are indirect mechanisms wherein the iodine-123 production route passes through the radioactive precursor xenon-123. The chemically inert and gaseous xenon-123 precursor rather than iodine-123 itself is generally separated from the irradiated target. The xenon-123 (which may be removed from the target either as it is being formed during the irradiation, or immediately after the irradiation, or both) is trapped in a vessel and allowed to decay to iodine-123.

Certain of these indirect reactions and associated methodologies are carried out using helium-3 and helium-4 ions of less than 50 MeV delivered via small accelerators such as the commercially available compact cyclotrons. An example is $^{122}$Te ($^{3}$He, 2n) $^{123}$Xe→$^{123}$I using approximately 27 MeV helium-3 ions. However, where a choice can be made based on accelerator capabilities, such indirect routes using modest bombarding energies are generally rejected by large-scale suppliers in favour of direct reactions on grounds of poor yields. Other reasons for rejection may be: the difficulties, time and expense in setting-up for helium ions in cases where the machine is more usually tuned for other particles such as protons, and the lower machine current available with helium ions as opposed to lighter particles.

In practice, the only indirect reaction routes exploited to any substantial extent are those depending upon the use of bombarding particle energies in excess of 50 MeV, i.e. energies beyond the scope of most medical accelerators and in particular the compact industrial cyclotrons in commercial hands. The most important indirect route used is the $^{127}I$ (p, 5n) $^{123}Xe \rightarrow ^{123}I$ mechanism using approximately 64 MeV protons. This mode of production, and its companion (d, 6n) reaction using approximately 78 MeV deuterons, are carried out at a few institutions in the world possessing large nuclear accelerators devoted mainly to non-commercial research applications in various fields. Supply, however, is not regular enough or in sufficient quantity to satisfy the full nuclear medical demand.

The indirect reaction routes have a decided advantage over the direct routes in terms of higher product purity. This is because the isotopes xenon-124 and xenon-126 produced and separated with the sought xenon-123 are stable and block the formation of iodine-124 and iodine-126 as contaminants. Xenon-125, however, is usually formed, leading to an iodine-125 contaminant level normally of about 0.2% at the time of iodine-123 product preparation. Iodine-125 is a less undesirable contaminant than iodine-124 or iodine-126 since it does not emit photon-radiation of energy sufficient to degrade diagnostic images. It does, however, contribute to patient radiation dose to about the same extent as iodine-124. This means that a 4% level of iodine-125 leads to thyroid doses increased by a factor of 4 relative to those delivered by pure preparations. Nevertheless, iodine-123 preparations via the indirect nuclear reaction route are regarded as medically much superior to direct reaction preparations. Product shelf-life is about 60 hours, if 4% iodine-125 is taken as limiting because of dose considerations.

OBJECT OF THE INVENTION

The object of the invention is to provide an economical and reliable means of producing the medically important radioisotope iodine-123 in high yield and high purity via a small nuclear accelerator.

The yield per unit of accelerator integrated beam (millicuries per microampere-hour) must be comparable to that obtained using the direct reaction $^{124}Te$ (p, 2n) $^{123}I$; the purity must be equivalent to, or better than, that attained via the indirect reaction $^{127}I$ (p, 5n) $^{123}Xe \rightarrow ^{123}I$ using large accelerators; the production mode must be within the particle energy capabilities of the commercially available compact cyclotrons, such as the CS-30, CP-42 and CP-45 modes of The Cyclotron Corporation (Berkeley, Calif.) and the MC-35 and MC-40 models of Scanditronix (Uppsala, Sweden); and the bombarding particles used to induce the nuclear reaction are preferred to be protons.

SUMMARY OF THE INVENTION

A production process has been invented which complies with the object of the invention stated above. The process utilises protons of about 30 MeV incident upon a target of isotopically enriched xenon-124 gas. It further utilises special means of handling the target gas and target assembly for recovery of the iodine-123. The product obtained by means of the invention has a useful life after factory preparation of at least 85 hours. This life is about 1 day longer than that of the best iodine-123 preparations currently (but not reliably or on a large-scale) on the market and about 2 days longer than the bulk of the commercially supplied iodine-123 on the market. This added life will greatly facilitate the commercial distribution and medical convenience of radiopharmaceutical products based on iodine-123.

DESCRIPTION OF THE DRAWINGS

The invention will now be described with reference to the accompanying drawings, in which.

DESCRIPTION OF THE PREFERRED EMBODIMENT

In the invention the following reaction pathways are simultaneously utilized:

$$^{124}Xe(p, 2n)^{123}Cs \rightarrow ^{123}Xe \rightarrow ^{123}I$$

$$^{124}Xe(p, pn)^{123}Xe \rightarrow ^{123}I$$

Furthermore, at higher proton energies within the selected range, the desired product will also be formed by higher energy reactions on the stable isotope xenon-126 (which is also enriched in the xenon-124 enriched target gas). This production route is represented as:

$$^{126}Xe(p, 4n)^{123}Cs \rightarrow ^{123}Xe \rightarrow ^{123}I$$

Other charged-particle reactions, namely (d, 3n), ($^{3}He$, 4n) and ($^{4}He$, 5n) on a xenon-124 target will also lead to the desired product via 123-chain precursors, although product yield will be lower and many compact cyclotrons may not be able to produce the required energy for these particles.

A xenon gas target is used, and one of the essential points in the procedure is the use of target gas which has been enriched in the xenon-124 isotope (and concomitantly enriched in the xenon-126 isotope). The natural abundance of this stable iostope is about 0.096% by volume, and an enrichment factor of greater than tenfold is required, and preferably greater than one hundred-fold, in order to achieve a good yield of product.

Another essential point is the energy bombardment to optimise the yield of product. This is chosen depending upon the target thickness, but is in the range of 45 MeV to 15 MeV for proton bombardment . . . well within the range attainable by many compact cyclotrons.

There are two modes of operation of the gas-target and associated decay-vessel equipment. Mode 1 is designed for the build-up and subsequent removal from the target assembly of xenon-123, which is then allowed to decay to the iodine-123 product in a decay-vessel separate from the target. Mode 2 is designed for the build-up, via the cesium-123 and xenon-123 precursors, of iodine-123 itself within the target assembly and its subsequent removal from the target assembly. Either Mode 1 or Mode 2 may be optimised with regard to iodine-123 yield or purity by choice of bombardment and decay periods and of processing steps. The optimisation of Mode 1 for a particular run does not preclude the use of the unoptimised Mode 2 to yield some product in the same run. For example, in a run which optimises Mode 1, the xenon-124 gas may be removed to the decay vessel after a fairly short (less than 3 hours) bombardment period. After this step, the Mode 2 process steps may be put into operation to remove from the target assembly iodine-123 which was formed within the target assembly via cesium-123 and xenon-123 decay during the bombardment.

Figure 1:
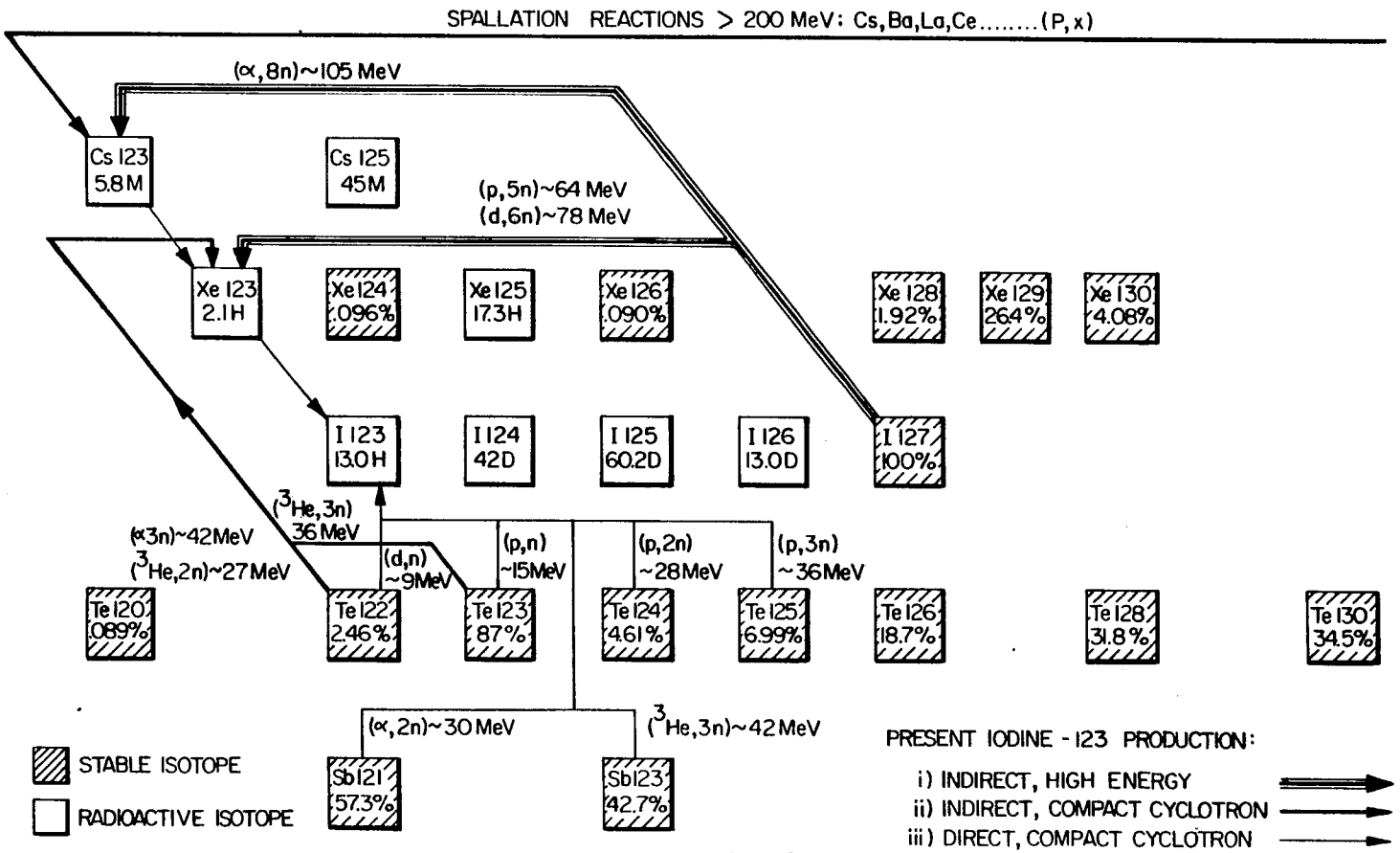
FIG. 1 is a chart indicating possible reaction pathways.
Figure 2:
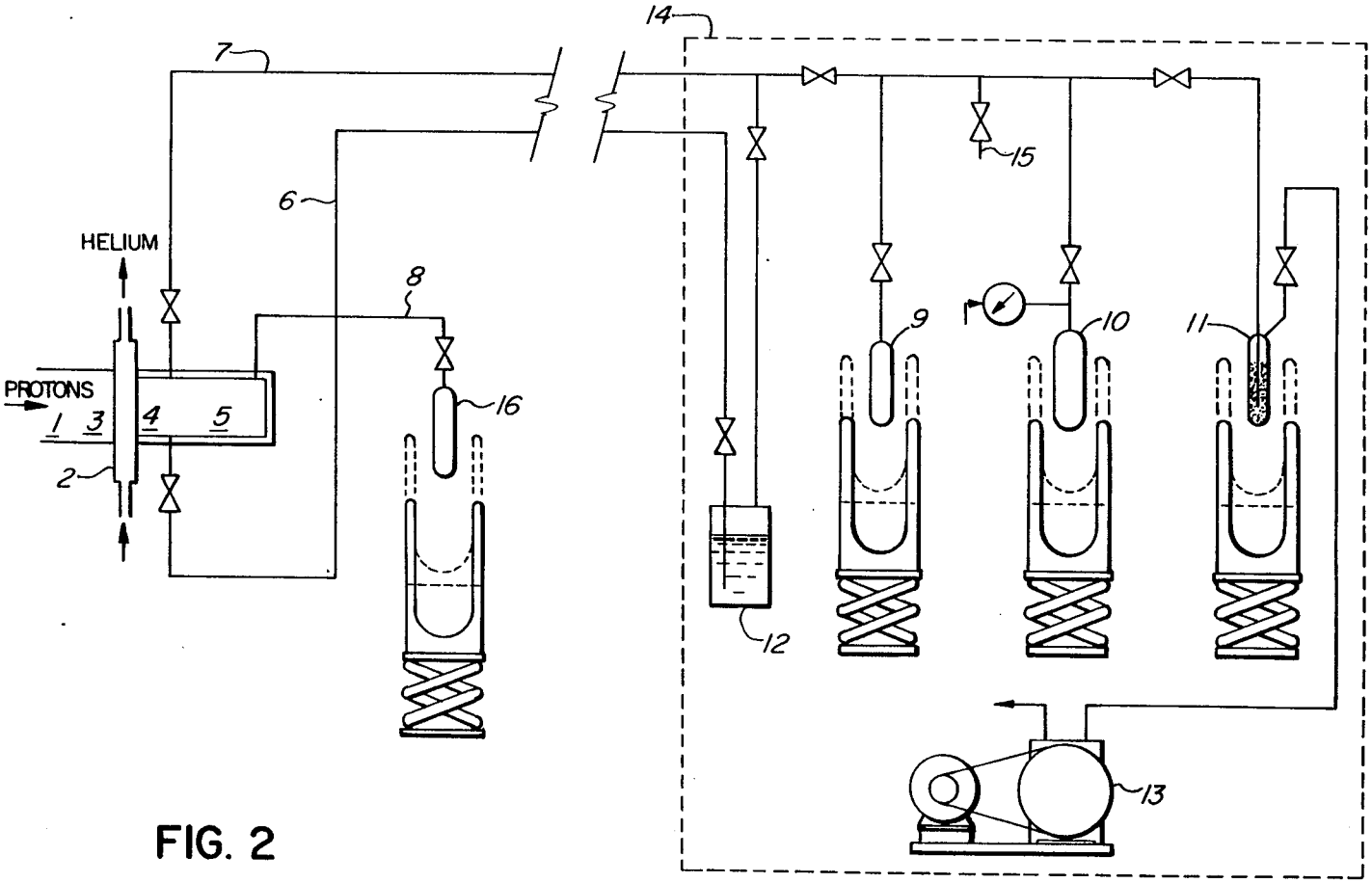
FIG. 2 is a schematic diagram of apparatus used in carrying the present invention into effect.

Reference is now made to the attached drawing, FIG. 2: Essentially monoenergetic protons in the energy range 45–15 MeV, or other charged particles such as deuterons or helium ions of energy such that they are capable of inducing 123-chain precursors of iodine-123, travel in a straight line in the direction shown along an evacuated beamline 1 external to a small nuclear accelerator such as a compact cyclotron. They pass essentially undeflected through thin metal windows 3, 4 cooled by a helium gas flow through the space 2 between the windows. The total energy loss in these windows and the helium stream is less than 2 MeV. They interact with xenon gas, which may be pressurized above atmospheric pressure (present target design to 10 atmospheres), and enriched in xenon-124 to an enrichment level greater than 1% by volume in the gas-target assembly 5. At the end of the chosen bombardment period, the charged-particle beam is turned off.

For Mode 1 operations, the irradiated gas may be at once cryogenically and quantitatively pumped to the shielded facility 14 through the gas line 7 to one of the gas decay vessels 9 which is cooled with liquid nitrogen. Here, the frozen gas is allowed to decay for a further chosen period before the decay vessel is allowed to return to room temperature while the gas is being cryogenically pumped to one of the gas storage vessels 10 cooled in liquid nitrogen. The vessel 10 is then valved closed and may be allowed to return to room temperature. The walls of the gas decay vessel are then washed with a basic aqueous solution, which could be dilute sodium hydroxide, to recover the deposited iodine-123 product.

For Mode 2 operations, the irradiated gas is allowed to remain in the target assembly for a chosen period after the bombardment in order to decay, and thereby add to the iodine-123 already formed within the target during the bombardment period. At the end of this further decay period, the gas is cryogenically and quantitatively transferred from the target assembly to the shielded facility 14 through the gas line 7 to one of the gas storage vessels 10 cooled in liquid nitrogen. The vessel 10 is then valved closed and may be allowed to return to room temperature. The target assembly 5 is then evacuated through gas line 7 and the gas scavenge trap 11 by means of the vacuum pump 13. An aqueous solution is then allowed to flow from the solution vessel 12 through the solution line 6 to fill the target assembly. The solution, after a chosen period of contact with the internal walls of the target assembly is then transferred back through solution line 6 to the solution vessel. (This process is aided by evacuation of the solution vessel using the pump 13 and by venting the target assembly using the vent line 15). The solution may be then used directly as the product or be subjected to further processing such as filtering or concentration.

The operative cycle as described above may then be repeated by freezing the target gas reservoir 16 with liquid nitrogen, evacuating the gas-target assembly 5 by means of the pump 13, and by cryogenic pumping to transfer xenon-124 target gas from a storage vessel 10 to the reservoir 16 via the gas target assembly. When sufficient gas has been transferred to the reservoir 16, the reservoir and gas-target assembly are isolated by appropriate valving and the reservoir (whose volume is small compared to that of the target assembly) is allowed to return to room temperature thereby allowing the gas to expand into the target assembly chamber. Bombardment of the gas target with charged particles can then recommence.

We claim:

1. A method of indirectly producing high-purity radioactive iodine-123 by means of the decay of 123-chain precursors thereof, said method comprising the steps of:

providing a gas-target assembly containing xenon gas enriched in the xenon-124 isotope, said gas target assembly having a deposit region on its interior surface for deposition of iodine-123, providing at least one gas decay vessel having at least one further deposit region located therein, said gas decay vassel being remotely disposed from the gas-target assembly, performing the following steps during a first predetermined period:

bombarding the gas within the gas-target assembly with a beam of protons of incident energy in the range of 45 MeV to 15 MeV to produce build-ups of both iodine-123 and xenon-123, and depositing the iodine-123 on said deposit region in the gas-target assembly;

transferring the irradiated xenon gas from the gas-target assembly to said gas decay vessel at the termination of said first predetermined period; and, during a second predetermined period, performing the following steps:

retaining the irradiated xenon gas in said decay vessel while the xenon-123 therein decays to iodine-123 and, washing said gas target assembly deposit region with a liquid to recover therefrom the iodine-123.

2. The method as claimed in claim 1, wherein after said second predetermined period said xenon gas is transferred to one or more gas storage vessels remotely disposed from said gas-target assembly and gas decay vessels for holding pending transfer of the xenon gas to the gas target assembly for further bombardment, said transfer to the gas target assembly being performed via a target gas reservoir which is cooled by liquid nitrogen and is connected to said gas target assembly, said method further including the steps of evacuating said gas-target assembly after said washing step, transferring enriched xenon gas from said gas storage vessel to said reservoir, isolating said reservoir and said gas-target assembly from said gas storage vessel by closure means, and returning said reservoir to room temperature to allow the xenon gas to expand and to return into said gas target assembly in preparation for another bombardment, thereby providing for recycling of the enriched xenon gas.

3. The method of claim 1 wherein said xenon gas is enriched in the stable xenon-124 isotope to a level of 1% or greater by volume.

4. The method of claim 1 wherein the iodine-123 is recovered from the said further deposit region of the gas-decay vessel or vessels by washing.

5. The method of claim 1 wherein said xenon gas is maintained in said gas-decay vessel or vessels at cryogenic temperatures during said second predetermined period.

6. The method of claim 1 wherein said gas-decay vessel or vessels are located in a radioactively shielded facility remotely disposed from the gas-target assembly.

7. The method of claim 1 wherein xenon gas is stored in one or more gas storage vessels; said gas-target assembly, gas-decay vessels and gas-storage vessels are connected to each other and to other parts of the equipment by valves and tubing and wherein transfer of said xenon gas between said components is via said valves and tubing and by cryogenic pumping means using liquid nitrogen as the cryogenic agent.

* * * * *

US004622201B1

REEXAMINATION CERTIFICATE (1886th)

United States Patent [19]

Robertson et al.

[11] B1 4,622,201

[45] Certificate Issued Dec. 22, 1992

[54] GAS-TARGET METHOD FOR THE PRODUCTION OF IODINE-123

[75] Inventors: Robert Robertson, Vancouver; Donald C. Stuart, Ottawa, both of Canada

[73] Assignee: Nordion International Inc., Kanata, Canada

Reexamination Request:
No. 90/002,164, Oct. 12, 1990

Reexamination Certificate for:

| | |
|---|---|
| Patent No.: | **4,622,201** |
| Issued: | **Nov. 11, 1986** |
| Appl. No.: | **409,376** |
| Filed: | **Aug. 18, 1982** |

[30] Foreign Application Priority Data

Jun. 1, 1982 [CA] Canada ..... 404175

[51] Int. Cl.[5] ..... G21G 1/10
[52] U.S. Cl. ..... 376/192; 376/195
[58] Field of Search ..... 376/192, 194, 195, 169

[56] References Cited

FOREIGN PATENT DOCUMENTS 671194 2/1980 U.S.S.R. .

OTHER PUBLICATIONS

Nordell, B. et al., "Production of $^{123}I$ by Photonuclear Reaction on Xenon", International Journal of Applied Radiation and Isotopes, vol. 33, Mar. 1982, pp. 183–187.

Grabmayr et al., "Statistical-Model Based Evaluations of Reactions Producing $^{123}I$ and $^{127}Xe$", International Journal of Applied Radiation and Isotopes, vol. 29, (1978), pp. 261–267.

Jungeman, et al., "Cyclotron Production of High--Purity Iodine-123 for Medical Applications", Journal of Radioanalytical Chemistry, vol. 65, No. 1–2, (1981) 31–45.

Isotopes and Radiation Technology, vol. 4, No. 3, (Spring 1967) Rhodes et al, pp. 275–280.

Trilinear Chart of the Nuclides, (Jan. 1979), by Mallinckrodt, Inc.

Radiochem. Radioanal. Letters, vol. 46, No. 5, (Feb. 26, 1981), pp. 285–290, Vandecasteele et al.

Fast Neutron Physics, Part II: Experiments and Theory, Marion et al, p. 1712.

Int. J. of Applied Radiation and Isotopes, vol. 31, pp. 85–90, by Brinkman, (Feb. 1980).

*Primary Examiner*—Harvey E. Behrend

[57] ABSTRACT

Charged-particles in the 45–15 MeV energy range incident upon isotopically enriched xenon-124 gas in a gas-target assembly cause nuclear reactions which yield radioactive xenon-123. The xenon-123, decaying either in the target assembly or in a decay vessel removed from the target assembly, yields iodine-123 with very low levels of radioactive contaminants.

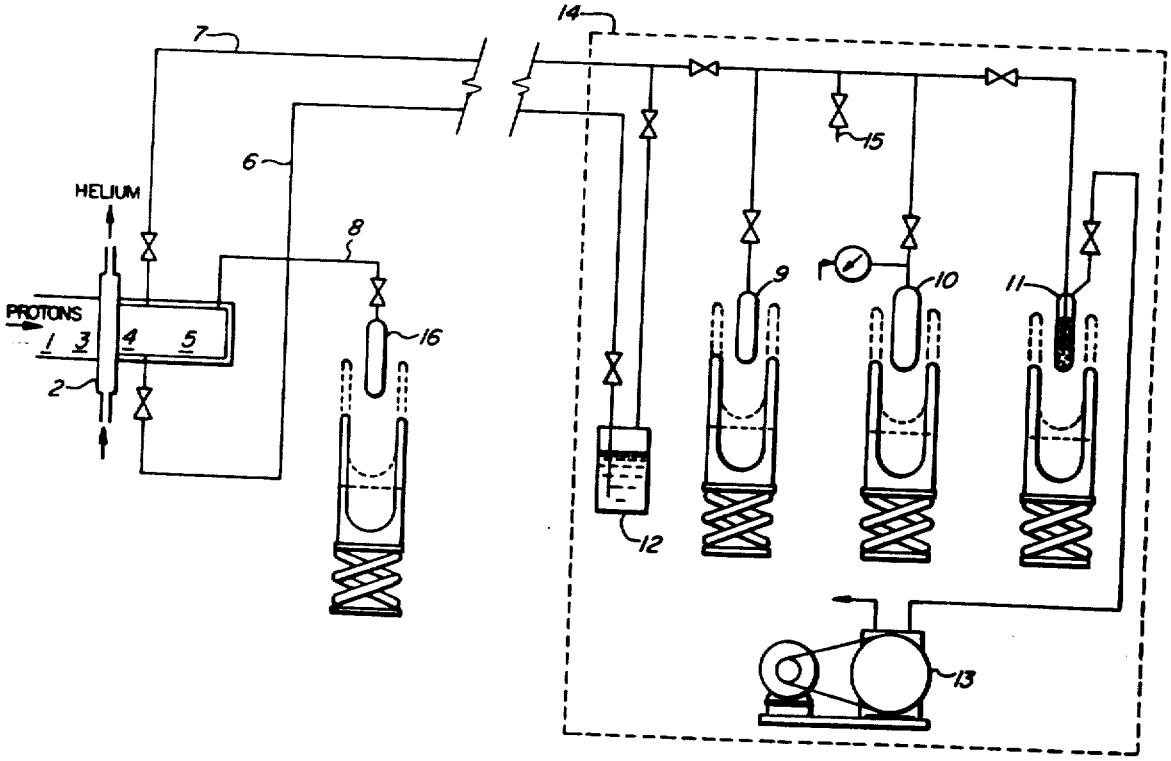

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *